US005429201A

United States Patent [19]

Saxman

[11] Patent Number: 5,429,201

[45] Date of Patent: Jul. 4, 1995

[54] DRILL BIT WITH IMPROVED ROLLING CUTTER TOOTH PATTERN

[75] Inventor: William C. Saxman, Dallas, Tex.

[73] Assignee: Dresser Industries, Inc., Dallas, Tex.

[21] Appl. No.: 178,568

[22] Filed: Jan. 7, 1994

[51] Int. Cl.[6] ..... E21B 10/16

[52] U.S. Cl. ..... 175/376; 175/377; 175/378

[58] Field of Search ..... 175/378, 376, 377, 374

[56] References Cited

U.S. PATENT DOCUMENTS

| | | | |
|---|---|---|---|
| 1,602,794 | 10/1926 | Erwin et al. . | |
| 1,905,860 | 4/1933 | Hammer . | |
| 1,906,427 | 5/1933 | Sievers et al. . | |
| 2,122,759 | 7/1938 | Scott | 175/376 X |
| 2,160,852 | 6/1939 | Ganthey | 175/364 X |
| 2,201,570 | 5/1940 | Zublin | 175/358 X |
| 2,248,339 | 7/1941 | Catland | 175/378 |
| 2,626,128 | 1/1953 | Boice | 175/376 X |
| 2,749,093 | 6/1956 | Peter | 175/376 X |
| 3,385,385 | 5/1968 | Kucera et al. | 175/378 X |
| 3,389,760 | 6/1968 | Morris . | |
| 4,056,153 | 11/1977 | Miglierini | 175/376 |
| 4,334,586 | 6/1982 | Schumacher | 175/374 |
| 4,393,949 | 7/1983 | Peterson | 175/377 |
| 4,420,050 | 12/1983 | Jones | 175/374 |

OTHER PUBLICATIONS

Security Division, Dresser Industries, Inc., "Serpentine Design No. 6 S8-Sb Cutter For Security Custom Hole Openers", *Field Technical Bulletin*, Jan. 1993.

Security Division, Dresser Industries, Inc., "Drilling Tools, Standard Hole Openers" #3364.

Security Division, Dresser Industries, Inc., "Drilling Tools, Custom Hole Openers" #3365.

*Primary Examiner*—Hoang C. Dang

*Attorney, Agent, or Firm*—Baker & Botts

[57] ABSTRACT

A drill bit includes a rolling cutter having a plurality of circumferential rows of teeth protruding from the body of the cutter. At least one of the rows of teeth is a closed-end circumferential row located on the surface of the cutter along a closed-end circumferential path. The latter is a non-circular curve defined by a surface intersecting the body of the cutter obliquely with respect to its longitudinal axis.

4 Claims, 5 Drawing Sheets

DRILL BIT WITH IMPROVED ROLLING CUTTER TOOTH PATTERN

BACKGROUND OF THE INVENTION

1. Technical Field

This invention relates generally to earth boring bits and in particular to the pattern of placement of cutting elements on a rolling cutter.

2. Background Information

Various forms of earth boring bits are utilized to cut through the hard material formations in the earth when forming a well bore. One general form of drill bit utilizes one or more rolling cutters whose outer surfaces include projections such as milled teeth or cutter inserts that gouge into the formation material causing the material to disintegrate or pulverize as the cutter is rotated when the tool is turned about its axis. The rolling cutters are individually mounted to rotate about a supporting shaft or spindle typically with the axis of the spindle spaced radially from and at an incline with respect to the rotational axis of the tool. The incline of the spindle axis causes the cutter to both rotate about its axis and roll relative to the bottom of a borehole as the bit body is rotated. As a result, the cutter disintegrates a concentric ring of formation material in the bottom of the borehole.

One earlier version of the foregoing general type of rolling cutter is disclosed in U.S. Pat. No. 3,389,760. The patent discloses a rolling cone cutter supported to rotate upon a load pin which is connected at its opposite ends to a generally U-shaped support saddle. As disclosed, a number of such saddle and rolling cutter arrangements may be mounted on a single bit body for drilling a large borehole. For disintegrating formation, a multiplicity of small inserts of cemented tungsten carbide are fitted into drilled holes in each cutter body. The inserts are disposed in overlapping rows so that as the cutter is rolled over the bottom of a hole the inserts cut overlapping tracks so as to disintegrate the formation over the full width of a concentric swath defined by the length of the cutter as it is rotated around the axis of the drill bit. The cutting elements of U.S. Pat. No. 3,389,760 are in somewhat of a semi-random pattern on a smooth outer surface of the cutter. This physical arrangement of cutting elements leaves certain lateral discontinuities in the bottom hole pattern. As a result, the non-uniform succession of cutting elements often imparts an abrupt impact force during rotation of the cutter. Moreover, by design the outer surface of the cutter does not have relief grooves which initially aid in carrying away a disintegrated formation with the drilling fluid.

Another form of prior art roller cutter is disclosed in U.S. Pat. No. 4,393,949 and includes a helix cutting tooth protruding from the cutter body. The helix shape of the tooth also functions to cut along the full width of the concentric swath relative to the central axis of the bit as the latter is rotated. However, the helix does not close upon itself and as a result, the open-ended helical cutting structure produces a bottom hole pattern that takes the appearance of a series of skewed or spiral open-ended grooves. Because of the open-ended helical design, the lead edge of the cutting tooth is subjected to a potentially abrupt load with each revolution of the cutter about its spindle axis.

SUMMARY OF THE INVENTION

The general aim of the present invention is to provide an arrangement of the cutter teeth on a roller cutter in a novel single pattern which can be utilized on essentially all of the roller cutters of a bit to avoid the problem of abrupt loading of the cutter teeth yet with the pattern still providing sufficient space for the provision of a groove along which drilling fluid can flow to carry away disintegrated formation material. More particularly, the present invention aims to achieve the foregoing by arranging the cutter teeth in at least one closed-end canted row on the surface of the cutter with the row having a first segment slanting away from a first end of the cutter and toward a second end while progressing in circumferential direction around the surface of the cutter and a second segment joined with the first and slanting toward the first end and away from the second end upon progressing further in the same concentric direction. More specifically, the invention resides in said first and second segments being formed in a circumferential path defined on the surface of the cutter by opposite first and second helical curves.

Invention also resides in the novel combination of concentric end rows of cutting teeth protruding from the surface of the cutter body relative to the axis of the cutter body and with one or more intermediate canted rows of cutter teeth mounted between the opposite end rows.

The foregoing and other advantages of the present invention will become more apparent from the following description of the best mode for carrying out the invention when taken in conjunction with the accompanying drawings.

FIGS. *3a–3d* are elevational views of the roller cutter of the present invention shown from each of four different sides to more clearly illustrate the surface pattern of cutter teeth placement.

Figure 4:
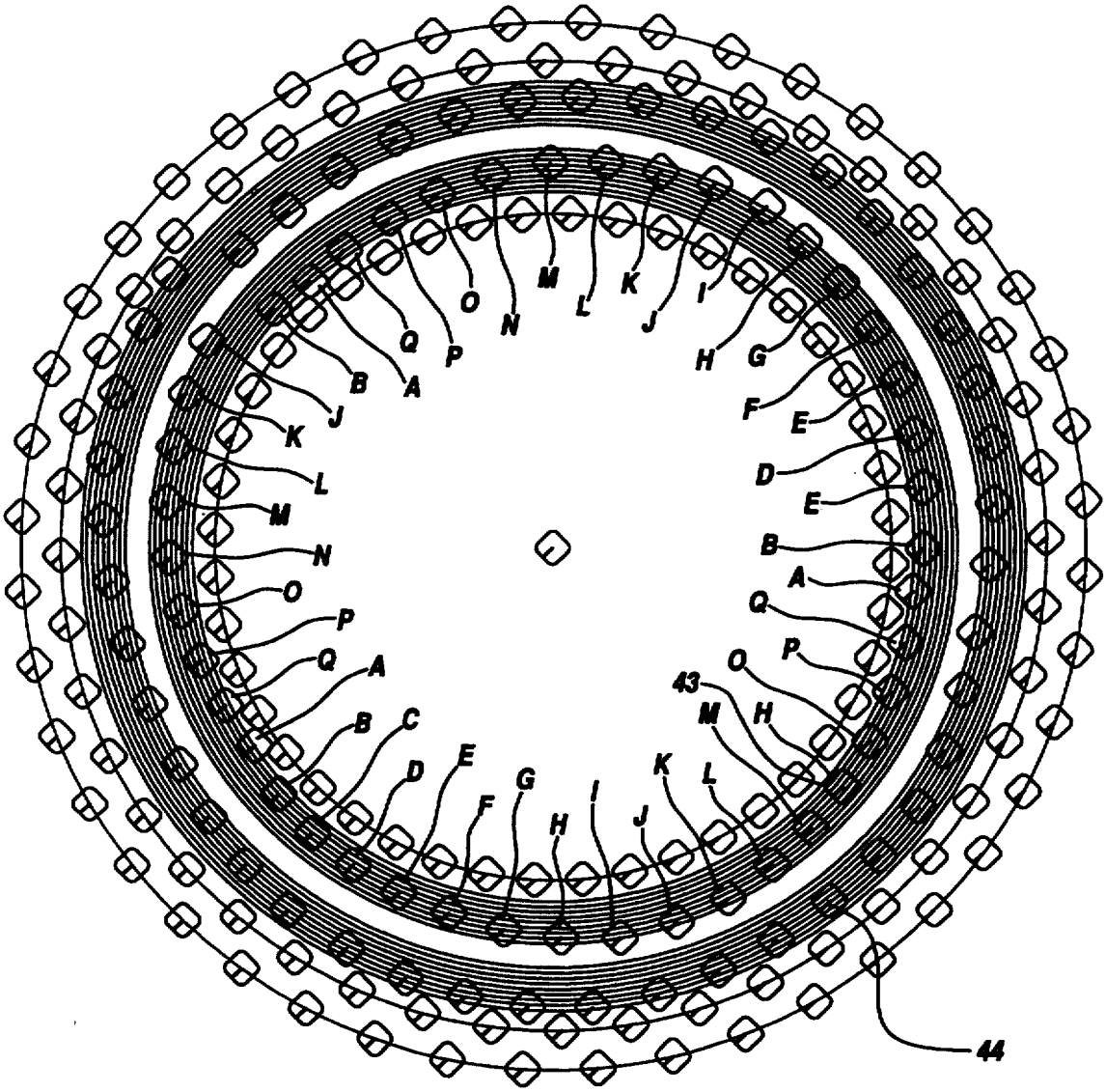

FIG. 4 is a bottom hole pattern produced with a single cutter when rotated about the axis of a drill bit with the individual contact points indicated for each of the cutter teeth as the cutter rotates about its axis.

Figure 5:
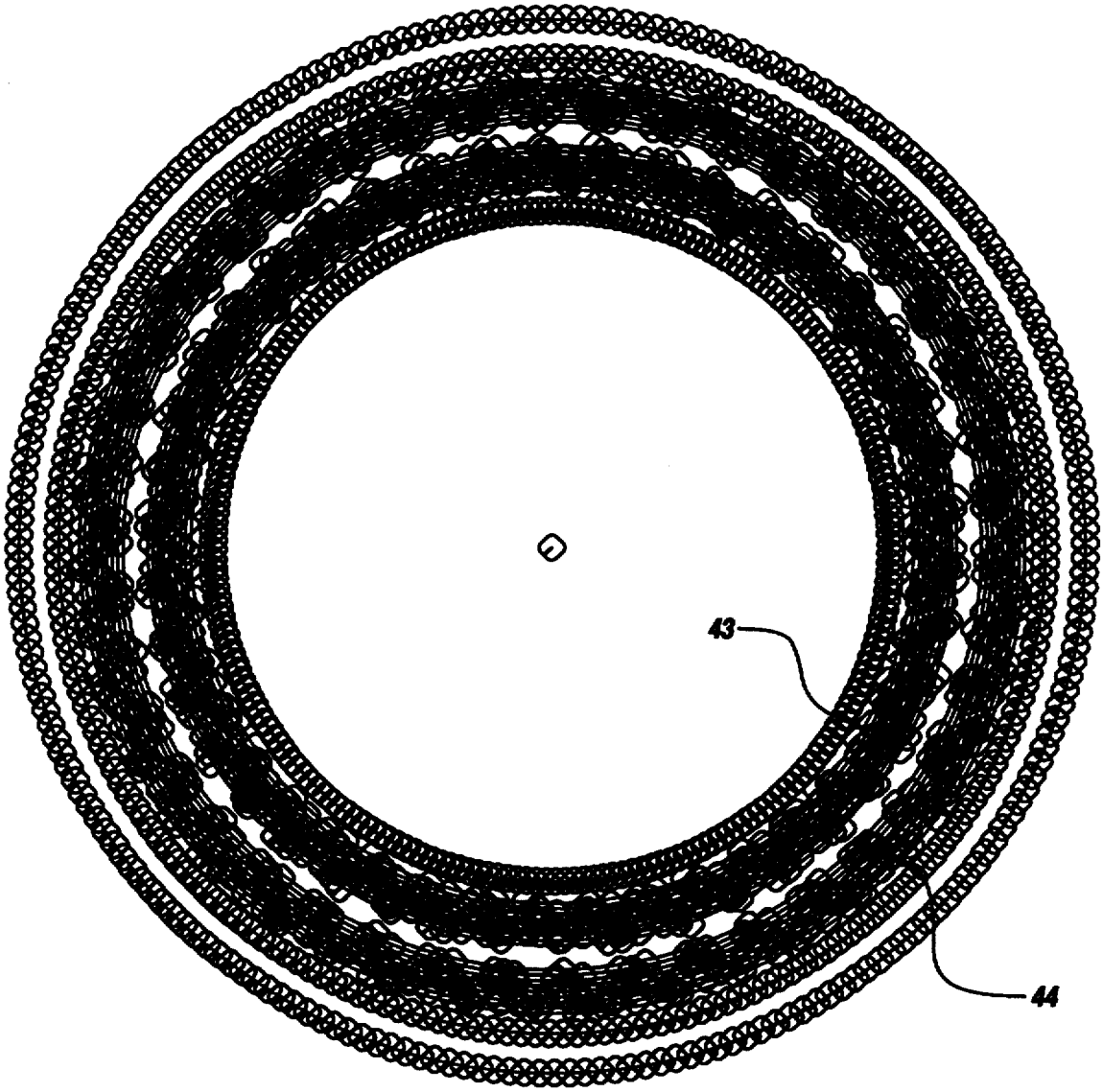

FIG. 5 is a bottom hole view similar to FIG. 4 but showing the cutter teeth contact points on the bottom hole produced with multiple revolutions of the drill bit.

Figure 6:
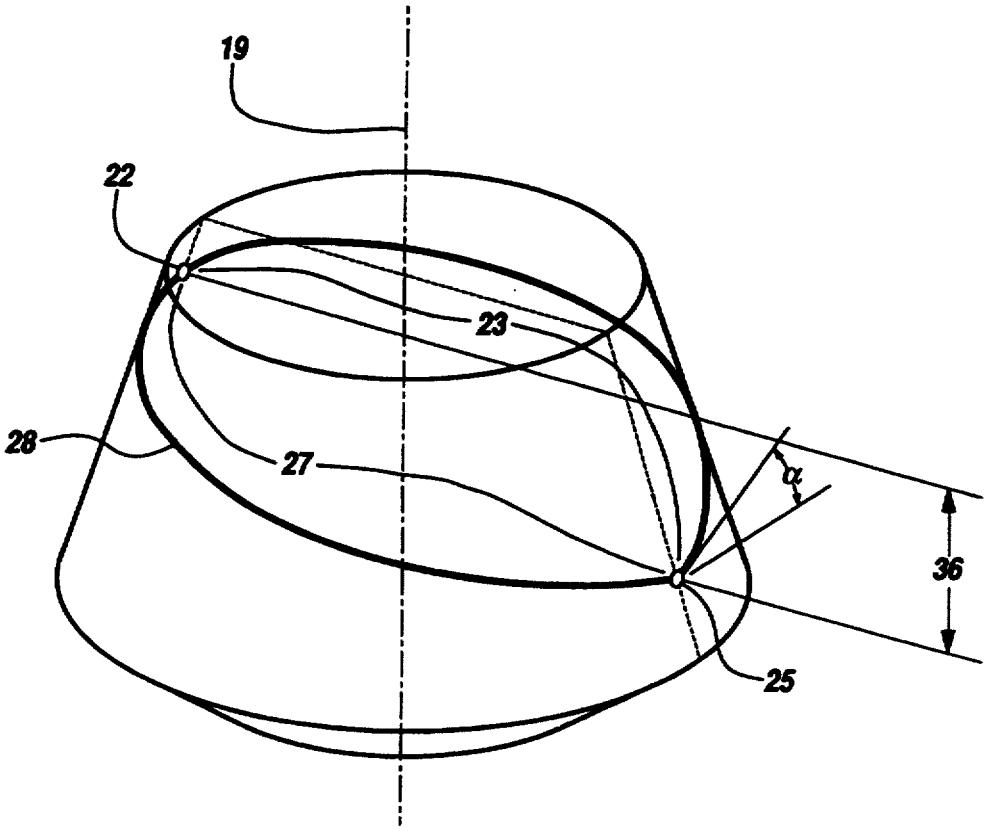

FIG. 6 is a representational view showing relative placement of parts of the invention.

BEST MODE FOR CARRYING OUT THE INVENTION

As shown in the drawings for purposes of illustration, the present invention is embodied in a drill bit commonly known as a hole opener 10. In the hole opener, a plurality of rolling cutters 11 are mounted on a bit body 13 adapted to be secured within a drill string in the usual manner by threads 14 at the top of the body. The cutters include outwardly projecting teeth 15 and are mounted intermediate the ends of the body on angularly spaced spindles 16 which are secured to radially protruding shoulders 17 constructed on the body. Longitudinal axes 19 of the spindles extend in generally radial directions relative to a central axis 20 of the body. Accordingly, when the hole opener is rotated with the drill string, the body rotates about its axis 20 in turn causing the cutters to rotate about their axes 19 so that the lower sides of each of the cutters rides around the periphery of a hole previously formed, with the teeth 15 of the cutters disintegrating the formation around the hole.

In accordance with the primary aspect of the present invention, the teeth 15 of the cutter 11 are arranged in a unique pattern including at least one closed-end canted row 21 on the surface of the cutter to avoid the impact loading problems associated with the row end teeth of prior art cutters. For this purpose, the canted row includes a first segment 23 (see FIGS. *3a–b*) which slants away from a first end 24 of the cutter upon progressing circumferentially along the surface of the cutter in a path defined by a helical curve from a starting position toward the second end 26 of the cutter for a first circumferential distance. Thereafter, a second segment 27 (see FIGS. *3c–d*) slants away from the second end and toward the first in an opposite path defined by a helical curve upon continuing in such circumferential direction a second distance back to the starting point. By virtue of this arrangement, as the cutter is rotated about its axis 19, the teeth within the canted row disintegrate a wide path of material in the formation being drilled.

Figure 2:
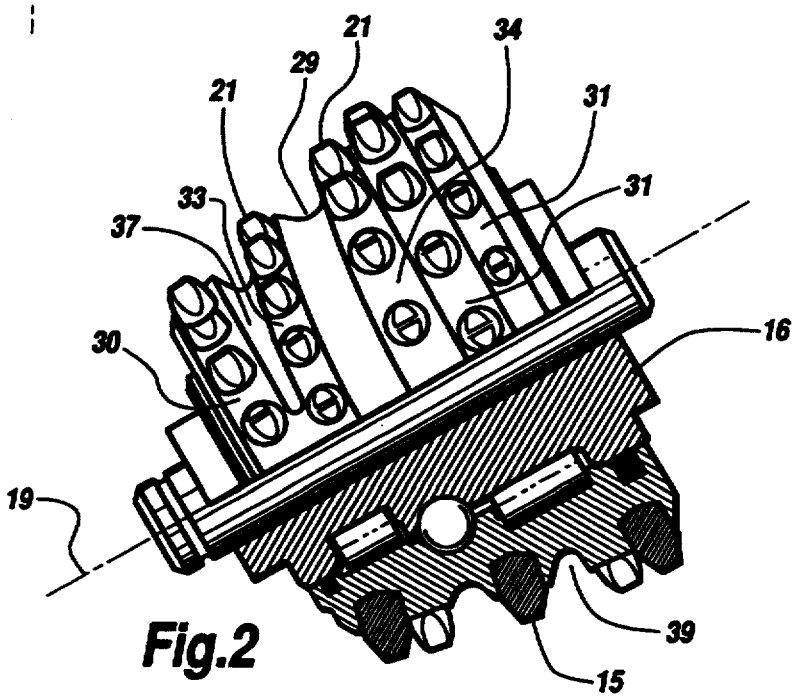
FIG. 2 is an enlarged perspective view of the roller cutter of the present invention.
Figure 3A:
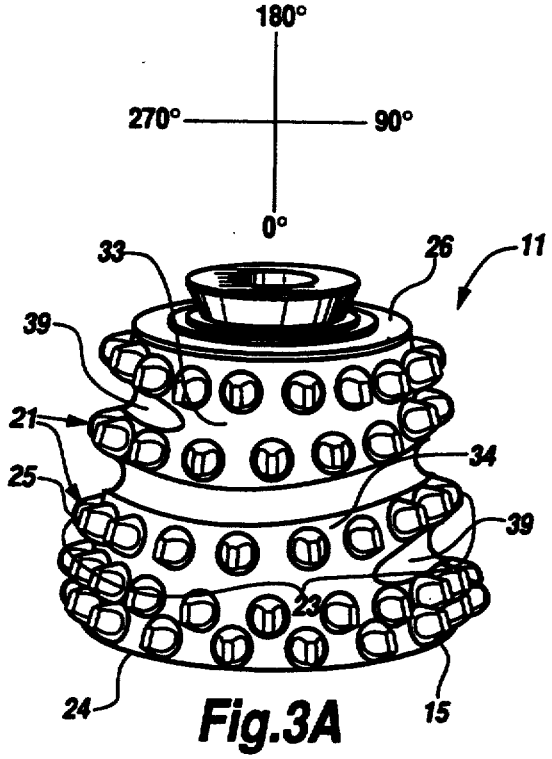
Figure 3B:
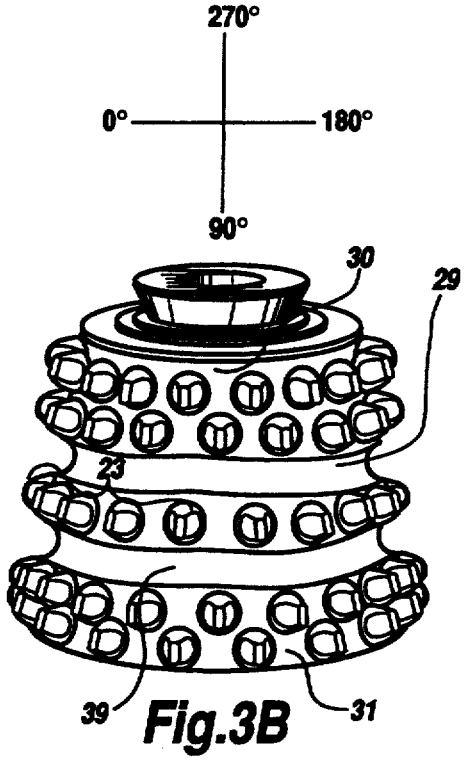
Figure 3C:
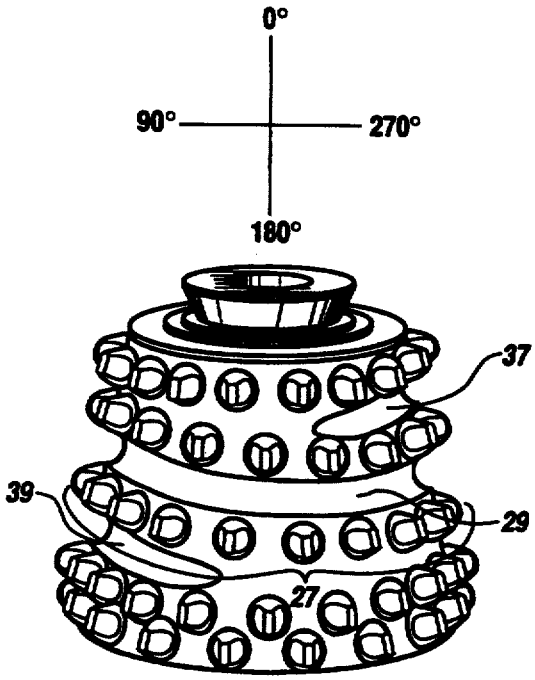
Figure 3D:
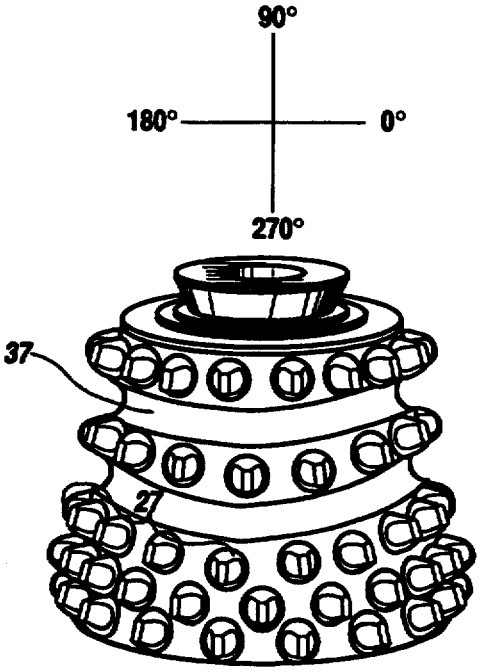

In the present instance, each of the cutters 11 is of a virtually identical configuration. Accordingly, only one of the cutters will be described in detail hereinafter it being appreciated that such description applies equally well to the other cutters mounted upon the body 13 of the hole opener 10. As shown in FIG. 2, the overall shape of the cutter is generally frustoconical in configuration. On the exemplary hole opener, the second end 26 of the cutter is located nearer the central axis 20 of the bit while the first end 24 is spaced radially farther outwardly of the central axis 20 of the bit. Preferably, the taper between the smaller and larger ends of the cutter is at a cone angle such that the outer surface of the cutter matches a natural roll about the central axis of the bit without undue skidding or sliding of the cutter teeth relative to the formation being disintegrated. The outer surface of the cutter includes a circumferentially extending annular groove 29 which is formed within the cutter body and provides a channel for carrying away disintegrated formation material. Also on the outer surface of the cutter are lands 30 and 31 extending in a circumferential direction. Adjacent the second end 26 is a first circumferential land 30 formed as a continuous single ring. Within the land are a plurality of sockets drilled in a radial direction for receiving the carbide teeth 15 with a press fit in the usual manner. Adjacent the first end 24 of the cone body are two similarly formed circumferential lands 31 containing additional carbide teeth mounted within sockets in a similar manner. Both of the lands 30 and 31 adjacent the first and second ends of the cutter, respectively, and the teeth mounted within these lands are located generally within planes which extend perpendicular to the longitudinal axis 19 of the cone body. Thus, the teeth within the lands 30 and 31 are located within circular rows concentric with the axis 19 of the cutter. Within the space between these circular rows of teeth are the two canted rows 21 of inserts. In the canted rows, lands 33 and 34 are separated by the circumferential relief groove 29. The canted row lands 33 and 34 are disposed on the surface of the cutter in substantially a radial direction relative to the axis 19. Specifically, the canted row of teeth 21 closest to the smaller end 26 of the cutter lies entirely within a closed-end circumferential path 28 (see FIG. 6) which is defined on the outside surface of the cutter by opposite first and second helical curves. The circumferential path thus formed includes the section 21 which beginning at the starting point 25 is closest to the smaller end of the cutter and extends along a path defined by a helical curve toward the larger end of the cutter upon progressing in a counterclockwise direction along the surface of the cutter until reaching a second point 22 that is closest to the larger end 24 of the cutter. Thereafter, continuing in a counterclockwise direction, the path 28 slants away from the larger end and toward the smaller end along a segment 27 that is defined by an opposite helical curve back to the starting point. The difference in height between the starting point 25 and the second point 22 defines a lateral displacement 36 (see FIG. 6) which is determined by the helix angle $\alpha$ and the physical cutter size. In the exemplary cutter, the lateral displacement is substantially one inch. The two canted rows 21 of teeth 15 which are shown on the exemplary cutter extending parallel to each other are defined in substantially the same manner with the circumferential relief groove 29 formed therebetween.

Figure 1:
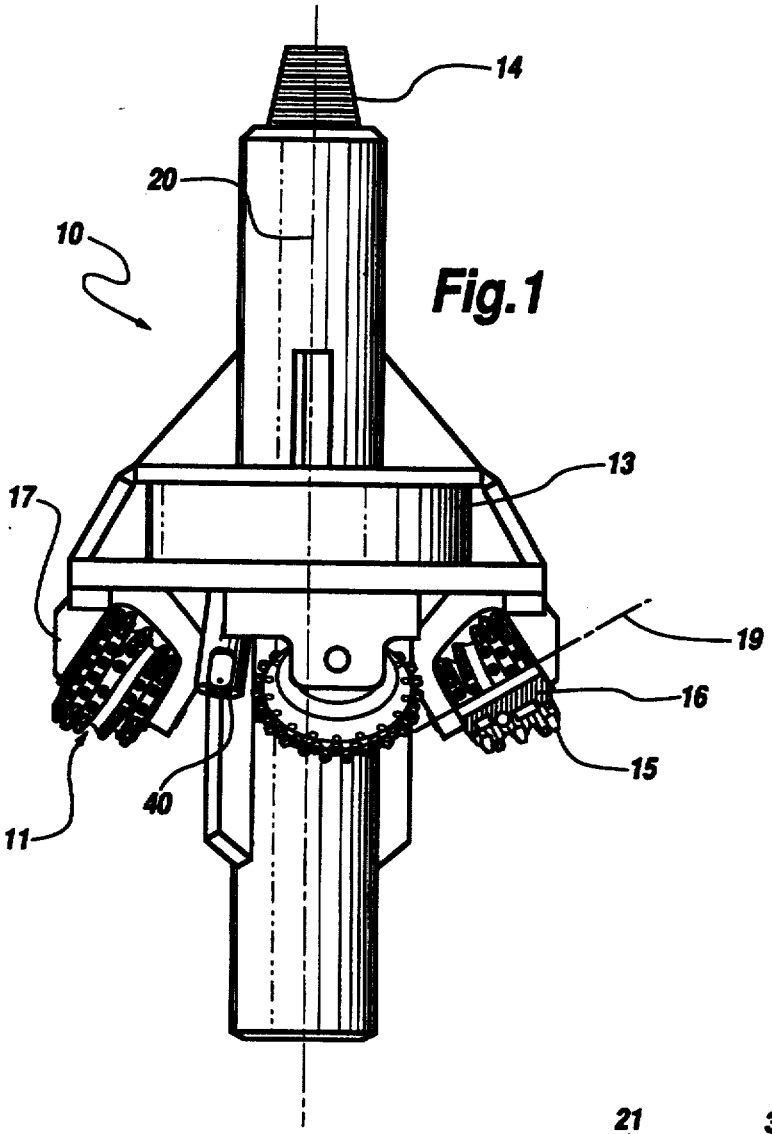
FIG. 1 is an elevational view of a drill bit having mounted thereon a roller cutter embodying the novel features of the present invention.

Herein, the latter is defined in a similar manner as that of the canted rows of teeth by milling opposite first and second helical grooves in the surface of the cutter generally centered between the canted rows of teeth. Additional crescent-shaped grooves 37 and 39 extend circumferentially between the canted rows of teeth and the adjacent circular lands 30 and 31. In the exemplary hole opener, the relief grooves 29, 37 and 39 are positioned relative to fluid injecting nozzles 40 (see FIG. 1) formed in the bit body 13 to help circulate disintegrated formation material away from the face of the cutter.

FIG. 4 depicts a representative bottom hole pattern which would be generated with a single cutter 11 as a result of a single revolution of the bit 11 about its axis 20. The two shaded ring areas 43 and 44 are representative of the ultimate width of two paths that are cut by the two canted rows 21 of inserts upon repeated revolution of the bit. The individual circular points are representative of the contact points made by each of the insert teeth 15 within each row upon contact with the bottom hole surface when completing only one revolution of the hole opener. The contact points are representative of only a single cutter for clarity of illustration. However, it will be appreciated that the exemplary hole opener 10 has a plurality of cutters 11 which are located to cut over the same paths around the borehole that is being enlarged. In rotating the bit through a single revolution, the cutter 11 will make several rotations about its central axis 19 in traversing the entire circumference of the hole that is being opened. In the shaded area 43 the individual contact points for the teeth are indicated by the letters A–Q. Because of the slanted circumferential positions of the teeth on the surface of the cutter, the radial positions of the contact points vary relative to the central axis of the tool upon progressing circumferentially around the cutter. Thus, the canted row of teeth follows a sinusoidal or serpentine pattern within the broader shaded curvilinear path 43 around the axis of the tool. Advantageously, this continuous translating action of the cutting elements can be used to effectively disintegrate the entire width of the path of formation material represented by the shaded area. Preferably, this is accomplished by choosing the circumferential length of the closed-loop path within which the canted inserts are located to be other than a whole number of rotations of the cutter about its axis. As a result, with successive revolutions of the tool, the individual inserts indent within the shaded area at different points. FIG. 5 illustrates this result showing the contact points for multiple revolutions of the bit body. Moreover, because the row of teeth is closed-ended it is not subjected to any excessive impact loading, and the indentations produced in the bottom hole pattern are relatively harmonic in nature.

By virtue of the foregoing described novel pattern for arranging the cutting teeth 15 of a roller cutter 11 on the surface of the cutter, overall drilling efficiency is improved achieving an effectively random yet controlled disintegration of a wide path of formation while also providing for easy and effective removal of the disintegrated material away from the action of the drill bit.

I claim:

1. A drill bit for disintegrating formation material at the bottom of a borehole including, a body rotatable about a central axis;

a spindle connected to said body and having a longitudinal axis spaced radially from said central axis;

a cutter mounted on said spindle to rotate about said longitudinal axis, said cutter having first and second ends and an outer surface extending therebetween concentric with said longitudinal axis; and a plurality of cutter teeth protruding from said outer surface for disintegrating formation material as said cutter is rolled across the formation rotating on said spindle to impact said cutter teeth against the formation as said bit body is rotated about said central axis, at least some of said cutter teeth being positioned on said cutter in a closed-end circumferential row located within a closed-end circumferential path defined on said outer surface of said cutter between said first and second ends, said path beginning at a starting point on said outer surface located at a first distance from said first end and progressing therefrom along said outer surface slantedly toward said second end in a circumferential direction for a first number of degrees to an intermediate point spaced a second distance from said first end greater than said first distance and thereafter progressing further in said circumferential direction slantedly toward said first end and away from said second end to return to said starting point.

2. A drill bit as defined by claim 1 wherein said starting point is the closest point on said path relative to said first end.

3. A drill bit as defined by claim 2 wherein said first number of degrees is one-hundred eighty degrees (180°).

4. A drill bit as defined by claim 3 including a second closed-end circumferential path extending parallel to said first-mentioned closed-end circumferential path, and a second row of said cutter teeth positioned on said cutter body within said second closed-end circumferential path.

* * * * *